US010993586B2

(12) United States Patent
Meise et al.

(10) Patent No.: US 10,993,586 B2
(45) Date of Patent: May 4, 2021

(54) SHOWER SHADE FOR COVERING HOT AND COLD SHOWER KNOBS AND FOR PROVIDING INTELLECTUAL ENGAGEMENT

(71) Applicants: Ashley Anne Meise, Northport, NY (US); Hudson Gabriel Meise Gaeta, Northport, NY (US)

(72) Inventors: Ashley Anne Meise, Northport, NY (US); Hudson Gabriel Meise Gaeta, Northport, NY (US)

( * ) Notice: Subject to any disclaimer, the term of this patent is extended or adjusted under 35 U.S.C. 154(b) by 19 days.

(21) Appl. No.: 16/454,861

(22) Filed: Jun. 27, 2019

(65) Prior Publication Data

US 2020/0000289 A1 Jan. 2, 2020

Related U.S. Application Data

(60) Provisional application No. 62/690,600, filed on Jun. 27, 2018.

(51) Int. Cl.

| | |
|---|---|
| ***A47K 3/28*** | (2006.01) |
| ***A63F 9/06*** | (2006.01) |
| ***A47K 3/34*** | (2006.01) |

(52) U.S. Cl.

CPC ..... *A47K 3/281* (2013.01); *A47K 3/34* (2013.01); *A63F 9/06* (2013.01)

(58) Field of Classification Search

CPC ..... A47K 3/281
USPC ..... 4/605
See application file for complete search history.

(56) References Cited

U.S. PATENT DOCUMENTS

| | | | | |
|---|---|---|---|---|
| 4,007,548 | A | 2/1977 | Cytanovich | |
| 5,732,419 | A * | 3/1998 | Feist | A47K 3/38 4/557 |
| 5,772,490 | A | 6/1998 | Leach | |
| 6,067,670 | A * | 5/2000 | Eddy | A47K 3/001 4/571.1 |
| 7,802,327 | B1 | 9/2010 | Moceri et al. | |
| 8,387,783 | B2 | 3/2013 | Zack et al. | |
| 8,894,417 | B2 | 11/2014 | Mandel | |
| 9,043,195 | B2 | 5/2015 | Paris | |
| 9,655,267 | B2 | 5/2017 | Cope et al. | |
| 9,907,438 | B2 * | 3/2018 | Ross | A47K 3/302 |
| 9,955,825 | B2 * | 5/2018 | Tsibulevskiy | A47K 3/38 |
| 2005/0069848 | A1 | 3/2005 | Cytanovich | |
| 2006/0232059 | A1 | 10/2006 | Fortune et al. | |
| 2007/0044928 | A1 | 3/2007 | Shannon et al. | |
| 2007/0212670 | A1 | 9/2007 | Paech et al. | |
| 2009/0004639 | A1 | 1/2009 | Stout et al. | |
| 2009/0202974 | A1 | 8/2009 | Sohn et al. | |
| 2016/0096397 | A1 | 4/2016 | Wakefield | |
| 2017/0238732 | A1 * | 8/2017 | Jackson | A47G 1/1606 |
| 2017/0265689 | A1 * | 9/2017 | Busillo | A47K 3/281 |

* cited by examiner

*Primary Examiner* — Christine J Skubinna
(74) *Attorney, Agent, or Firm* — Dunlap Bennett & Ludwig, PLLC

(57) ABSTRACT

A shower shade includes a curtain support and a curtain coupled to and hanging from the curtain support. The curtain may be made of a water impermeable material. A connector is coupled to the curtain support and is configured to releasably couple the curtain support to a shower head, a shower arm, or a shower caddy of a shower so that the curtain covers at least one hot and cold water knob in the shower. The shower shade further provides intellectual engagement.

9 Claims, 4 Drawing Sheets

SHOWER SHADE FOR COVERING HOT AND COLD SHOWER KNOBS AND FOR PROVIDING INTELLECTUAL ENGAGEMENT

CROSS-REFERENCE TO RELATED APPLICATION

This application claims the benefit of priority of U.S. provisional application No. 62/690,600, filed Jun. 27, 2018, the contents of which are herein incorporated by reference.

BACKGROUND OF THE INVENTION

The present invention relates to shower shades and, more particularly, to a shade used to distract sensory-sensitive people from the feeling of the water in the shower, to provide an opportunity for both sensory-sensitive and non-sensory sensitive people to use educational materials in the shower, and to prevent young children from seeing and touching the hot and cold water knobs in the shower.

Many people are very sensory sensitive. Some of these people avoid taking a shower or washing their hair because of the feeling of the water. If they are not able to perform these basic functions, it can have a negative impact on their social development and personal and professional interactions. Another challenge is to provide an opportunity for people to use educational materials in the shower. Another challenge is preventing young children from seeing and touching the hot and cold water knobs in the shower. If they do touch the knobs, they may inadvertently make the water too hot and injure themselves.

Existing bath toys are geared to young children and do not require complex intellectual engagement. Other products do not provide the opportunity for complex intellectual engagement in the shower without the use of a computer screen. Other products do not provide the opportunity for complex intellectual engagement that involves hands-on manipulatives in the shower. Other products are not designed to cause the user to stand in the shower water stream. Other products do not entirely block the view of and/or access to the hot and cold water knobs in the shower.

As can be seen, there is a need for a shade that can be used to distract sensory-sensitive people from the feeling the water in the shower, to provide an opportunity for both sensory-sensitive and non-sensory sensitive people to use educational materials in the shower, and to prevent young children from seeing and touching the hot and cold water knobs in the shower.

SUMMARY OF THE INVENTION

In one aspect of the present invention, a shower shade comprises: a curtain support; a curtain coupled to and hanging from the curtain support; and a connector coupled to the curtain support and configured to releasably couple the curtain support to a shower head, a shower arm, or a shower caddy of a shower.

In another aspect of the present invention, a method of covering at least one hot and cold water knob in the shower comprises steps of: providing a shower shade comprising: a curtain support; a curtain coupled to and hanging from the curtain support; and a connector coupled to the curtain support; and releasably attaching the connector to a shower head, a shower arm, or a shower caddy of a shower, wherein the curtain drapes over the at least one hot and cold water knob in the shower.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a retractable shade for use in a shower that addresses sensory sensitivity by distracting the person using it from the feeling of the water. In one embodiment, the shade is used to display interesting pictures or to display educational material. In one embodiment, the present invention is customized to present information and/or materials that are particularly interesting to the user and/or educational. Examples include, but are not limited to, matching upper case and lower-case letters, the elements of the periodic table, numbers and math symbols, multiplication tables, flashcards, etc. The retractable shade is attached to a shower head, a shower arm or a shower caddy of a shower at the top and to a spout at the bottom. The present invention further covers the front of the hot and cold water knobs in the shower and prevents young children from seeing them or easily accessing them. The present invention is further designed to be used by a sensory-sensitive person or a non-sensory sensitive person and to encourage them to stand in the shower water stream.

Figure 1:
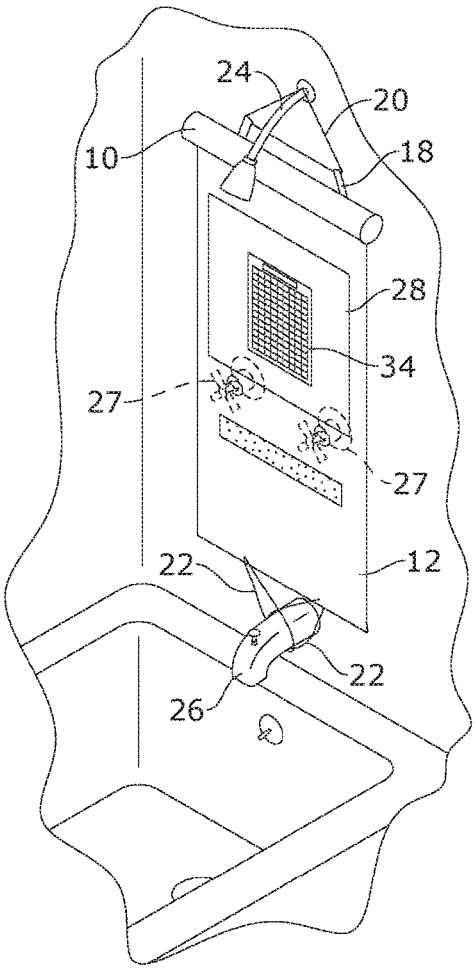
FIG. 1 is a perspective view of an embodiment of the present invention, shown in use.
Figure 2:
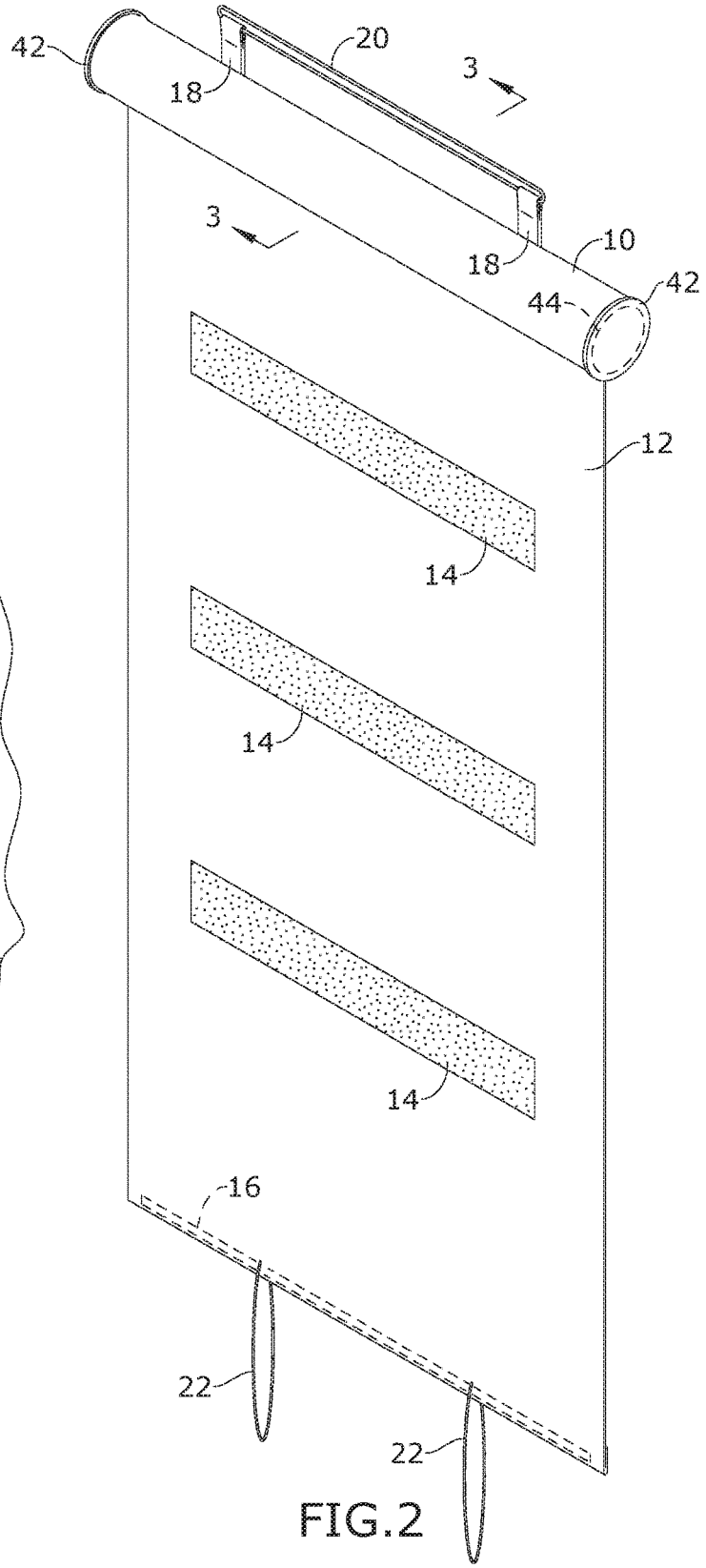
FIG. 2 is a perspective view of an embodiment of the present invention.
Figure 3:
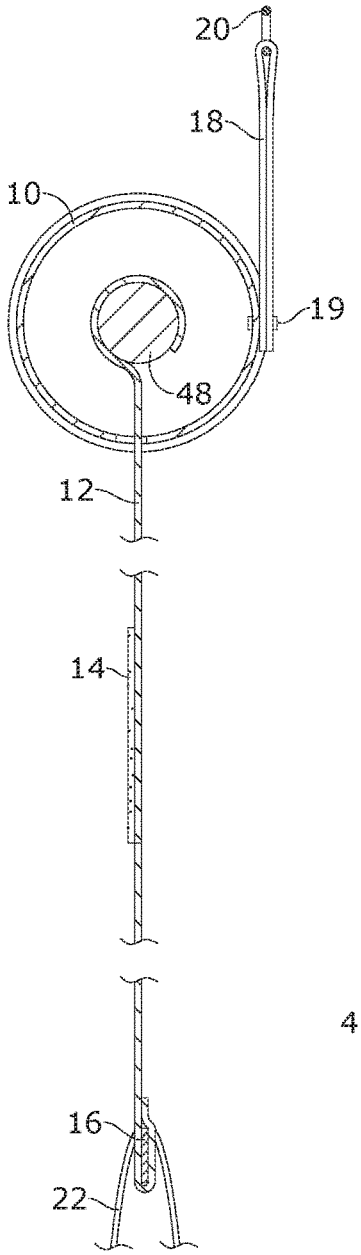
FIG. 3 is a section view of the present invention taken along line 3-3 in FIG. 2.
Figure 4:
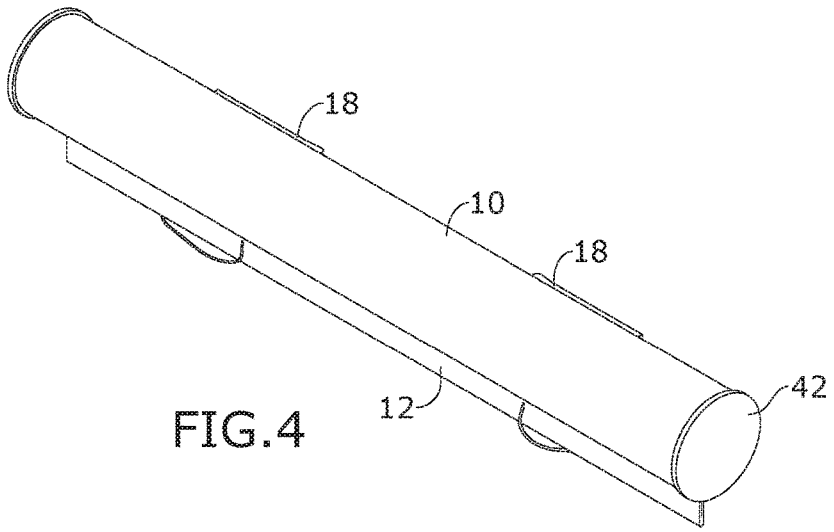
FIG. 4 is a front perspective view of an embodiment of the present invention, illustrated in a retracted position.
Figure 5:
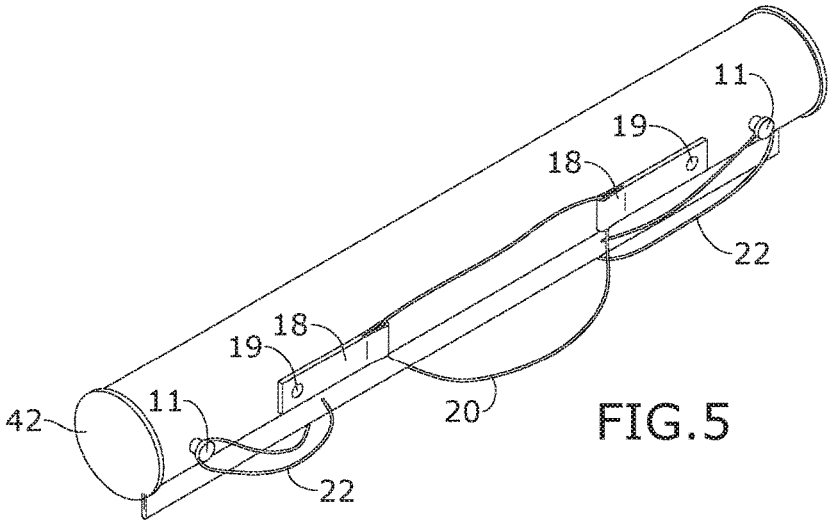
FIG. 5 is a rear perspective view of an embodiment of the present invention, illustrated in a retracted position.
Figure 6:
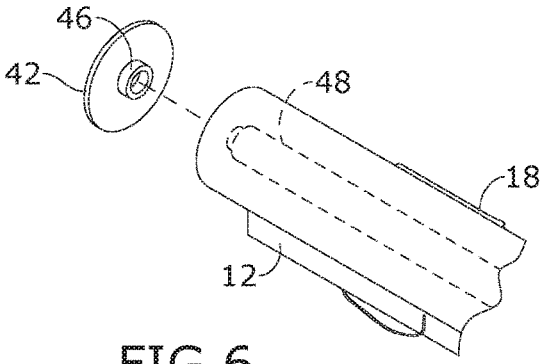
FIG. 6 is a detailed exploded view of an embodiment of the present invention.
Figure 7:
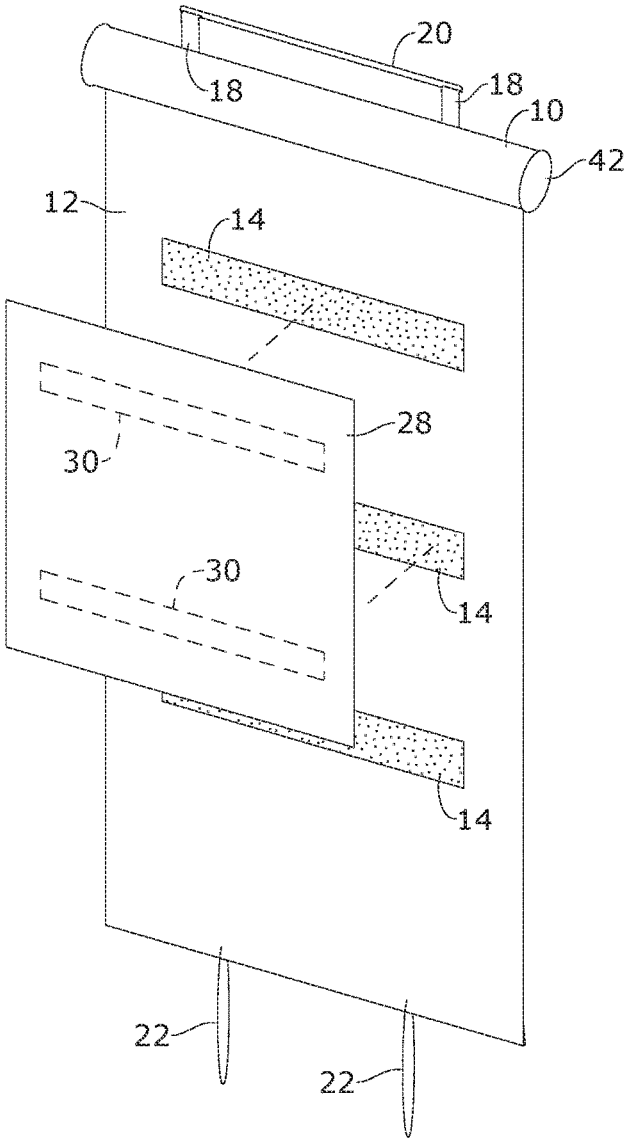
FIG. 7 is a perspective exploded view of an embodiment of the present invention, illustrating an attachment of a whiteboard to a curtain.
Figure 8:
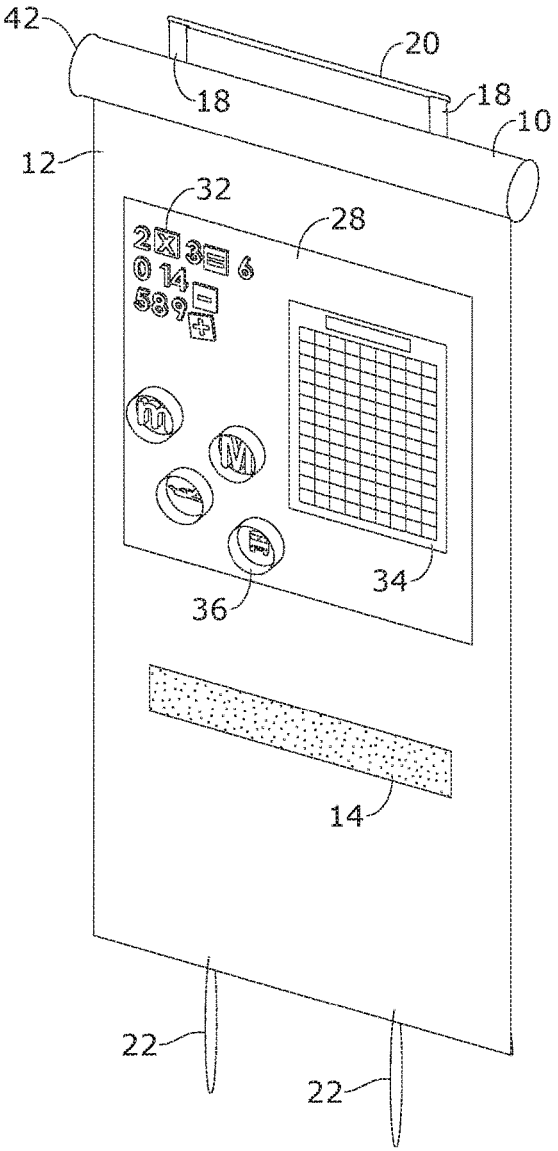
FIG. 8 is a detail perspective view of an embodiment of the present invention.
Figure 9:
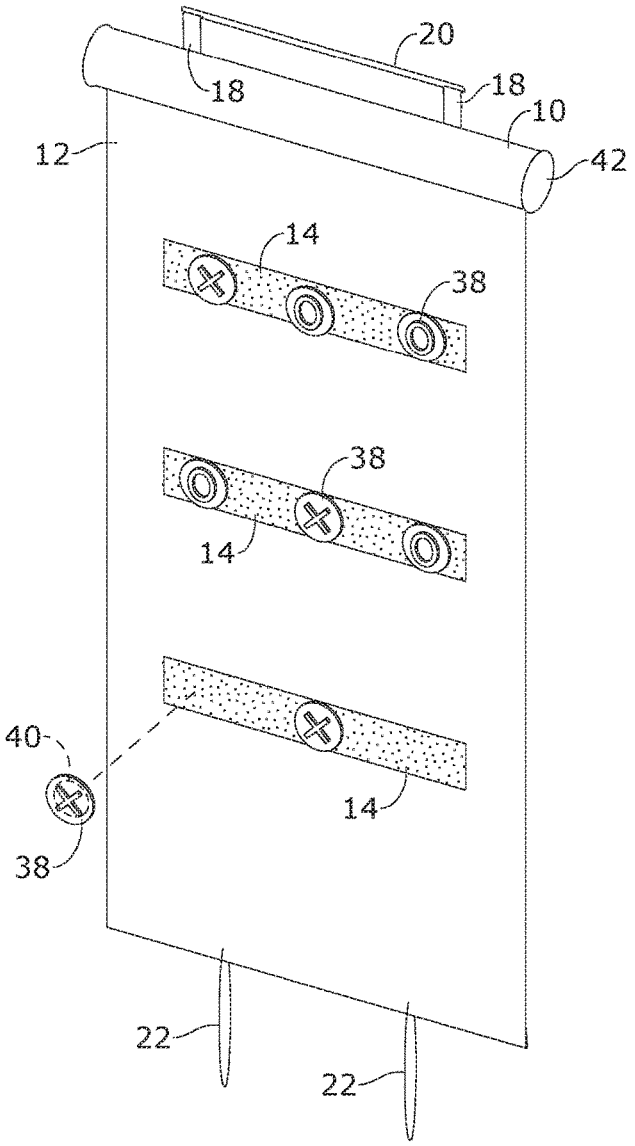
FIG. 9 is a perspective view of an embodiment of the present invention.
Figure 10:
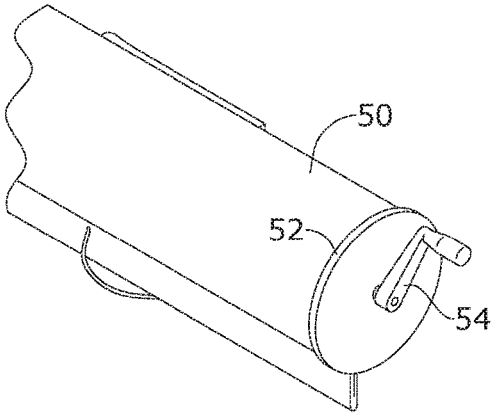
FIG. 10 is a detail perspective view of an embodiment of the present invention.

Referring to FIGS. 1 through 10, the present invention includes a shower shade. The shower shade includes a curtain support 10 and a curtain 12 coupled to and hanging from the curtain support 10. The curtain 12 may be made of a water impermeable material and may further include a bottom support bar 16 disposed at the bottom edge. A connector 18, 20 is coupled to the curtain support 10 and is configured to releasably couple the curtain support 10 to a shower head, shower arm, or shower caddy 24 in a shower.

The curtain 12 may be retractable and deployable. In such embodiments, the curtain support 12 is a housing. The deployed position includes the curtain 12 hanging out of the curtain support 10 and the retracted position includes the curtain 12 rolled up and substantially inside the curtain support 10. In certain embodiments, the present invention includes a rod 48 rotatably coupled to end cap posts 46 of end caps 42. The rod 48 is disposed within the housing. The end caps 42 may include a graphical display 44. The present invention may further include a spring coupled to the rod 48. In such embodiments, the curtain 12 may be pulled out from the retracted position and may lock in the deployed position. To convert the curtain 12 back to the retracted position, the curtain 12 is pulled down to unlock the spring and the spring biases the rod 48 to rotate and roll the curtain 12 back into the curtain support 12. Alternatively, a housing 50 may include an end cap 52 with a crank 54. The crank 54 is coupled to the rod 48. Rotating the crank 54 rotates the rod 48 and thereby converts the curtain from the retracted position to the deployed position and from the deployed position to the retracted position. Alternatively, the curtain 12 may be unrolled to the deployed position by hand before use and returned to the rolled up position by hand after use.

In certain embodiments, toys and learning tools may be releasably attached to the curtain 12. The curtain 12 includes a front surface and a rear surface. A connector may be coupled to the front surface. The connector allows the toys and learning tools to be coupled directly to the front surface of the curtain 12. The connector may include, but is not limited to, hook and loop strips 14, magnets, snap buttons, and the like.

The present invention may further include a magnetic whiteboard 28 with a magnetic chart 34. The magnetic whiteboard 28 is waterproof and releasably attaches to the curtain 12 by hook and loop strips 30, magnets, snap buttons, and the like. The present invention may further include waterproof magnetic digit and math symbol tiles 32, a multiplication table, a periodic table chart, and waterproof flashcards that attach to either the whiteboard 28 or directly to the curtain 12 by hook and loop fasteners, magnets, snap buttons, and the like. The present invention may include other attachment waterproof decor 36 (i.e., letters, pictures of cartoon characters, tranquil scenes, etc.) either printed on the curtain 12 and/or end cap 42 or releasably attachable to the curtain 12 or whiteboard 28 by hook and loop fasteners, magnets, snap buttons, and the like. For example, the present invention may include tic tac toe pieces 38 that include hook and loop patches 40 releasably attachable to the hook and loop strips 14 of the curtain 12.

In certain embodiments, the connector 18, 20 includes hanger tabs 18 extending from a top of the curtain support 10, and an upper hanging band 20 coupled to the hanger tabs 18. The hanger tabs 18 may be coupled to the curtain support 10 by a swivel 19, which relieves pressure when hanging from the shower head, shower arm, or shower caddy 24. The upper hanging band 20 may run through loops of the hanger tabs 18 and may directly hang from a shower head, a shower arm, or a shower caddy 24 of a shower. The present invention may further include lower hanging bands 22 coupled to a bottom edge of the curtain 12. The lower hanging bands 22 wrap around a tub spout 26, further securing the curtain 12. The upper hanging bands 20 and the lower hanging bands 22 may be made of waterproof/resistant elastic or rubber loops. The present invention may further include band hanging posts 11 to hang the bands 20, 22 when the present invention is in stowage.

A method of covering at least one hot and cold water knob, such as a pair of hot and cold water knobs, in the shower 27 and providing entertainment may include the following steps. Provide the shower shade described above. Releasably attach the connector 18, 20 to a shower head, a shower arm, or a shower caddy 24 of a shower. The curtain drapes 12 over the hot and cold water knobs in the shower 27. The method may further include steps of converting the curtain 12 from the retracted position to the deployed position. For example, the steps may include rotating the crank or pulling the curtain 12 out of the curtain support 10. In certain embodiments, the shower shade may be coupled within a shower by hanging the upper hanging band 20 from the shower head, shower arm, or shower caddy 24 of the shower and wrapping the lower hanging bands 22 around a tub spout 26.

It should be understood, of course, that the foregoing relates to exemplary embodiments of the invention and that modifications may be made without departing from the spirit and scope of the invention as set forth in the following claims.

What is claimed is:

1. A method of covering at least one hot and cold water knob in the shower comprising steps of:

providing a shower shade comprising:

a curtain support;

a curtain coupled to and hanging from the curtain support; and a connector coupled to the curtain support, wherein the connector comprises hanger tabs extending from a top of the curtain support, and an upper hanging band coupled to the hanger tabs; and a lower hanging band coupled to a bottom edge of the curtain;

releasably attaching the connector to a shower head, a shower arm, or a shower caddy of a shower, wherein the curtain drapes over the at least one hot and cold water knob in the shower;

hanging the upper hanging band over the shower head, shower arm, or shower caddy of the shower; and wrapping the lower hanging band around a tub spout.

2. The method of claim 1, wherein the curtain support is a housing, wherein the curtain comprises a deployed position and a retracted position, wherein the deployed position comprises the curtain hanging out of the curtain support and the retracted position comprises the curtain rolled up and substantially inside the curtain support.

3. The method of claim 2, further comprising steps of:

converting the curtain from the retracted position to the deployed position.

4. The method of claim 3, wherein a rod is rotatably coupled within the housing, the curtain is coupled to the rod, and a crank is coupled to the rod.

5. The method of claim 4, wherein the step of converting the curtain from the deployed position to the retracted position comprises rotating the crank.

6. The method of claim 3, wherein a rod is rotatably coupled within the housing, the curtain is coupled to the rod, and a spring is coupled to the rod.

7. The method of claim 6, wherein the step of converting the curtain from the retracted position to the deployed position comprises pulling the curtain out of the curtain support.

8. The method of claim 1, wherein the curtain comprises a front surface and a rear surface, wherein the front surface comprises at least one hook and loop strip.

9. The method of claim 8, wherein a magnetic whiteboard comprising a hook and loop strip is releasably attached to the at least one hook and loop strip of the curtain.

* * * * *